US007559377B2

(12) United States Patent
Stoetzer

(10) Patent No.: US 7,559,377 B2
(45) Date of Patent: Jul. 14, 2009

(54) CONSTRUCTION APPARATUS

(75) Inventor: Erwin Stoetzer, Aichach (DE)

(73) Assignee: Bauer Maschinen GmbH, München (DE)

( * ) Notice: Subject to any disclaimer, the term of this patent is extended or adjusted under 35 U.S.C. 154(b) by 0 days.

(21) Appl. No.: 11/297,325

(22) Filed: Dec. 9, 2005

(65) Prior Publication Data

US 2006/0124330 A1 Jun. 15, 2006

(30) Foreign Application Priority Data

Dec. 10, 2004 (EP) ..... 04029335

(51) Int. Cl.
*B25Q 5/00* (2006.01)

(52) U.S. Cl. ..... 173/147; 173/148; 173/141

(58) Field of Classification Search ..... 173/28, 173/31, 81, 141, 147, 148
See application file for complete search history.

(56) References Cited

U.S. PATENT DOCUMENTS 3,146,836 A 9/1964 Lee
3,508,619 A * 4/1970 Huffman ..... 173/147
3,820,612 A 6/1974 Snyder et al.
4,020,909 A 5/1977 Airaudo et al.
4,050,526 A * 9/1977 Deike ..... 173/27
4,637,475 A * 1/1987 England et al. ..... 173/193

FOREIGN PATENT DOCUMENTS

| | | | |
|---|---|---|---|
| DE | 8616401 | U1 | 9/1986 |
| JP | 04-179789 | A | 6/1992 |
| JP | 10-266762 | A | 10/1998 |
| JP | 11264137 | | 9/1999 |
| JP | 2000017658 | A | 1/2000 |
| SU | 1232774 | | 5/1986 |

* cited by examiner

*Primary Examiner*—Rinaldi I. Rada
*Assistant Examiner*—Nathaniel Chukwurah
(74) *Attorney, Agent, or Firm*—Jacobson Holman PLLC

(57) ABSTRACT

The invention relates to a construction apparatus comprising a mast, a slide guided in a longitudinally displaceable manner on a front side of the mast, at least one drive chain for the slide arranged longitudinally to the mast and at least one drive pinion supported on the slide in a rotatable and drivable manner, which is engaged with the drive chain. Provision is made for the drive chain and the drive pinion to be arranged in front of the front side of the mast.

17 Claims, 1 Drawing Sheet

CONSTRUCTION APPARATUS

Figure 1:
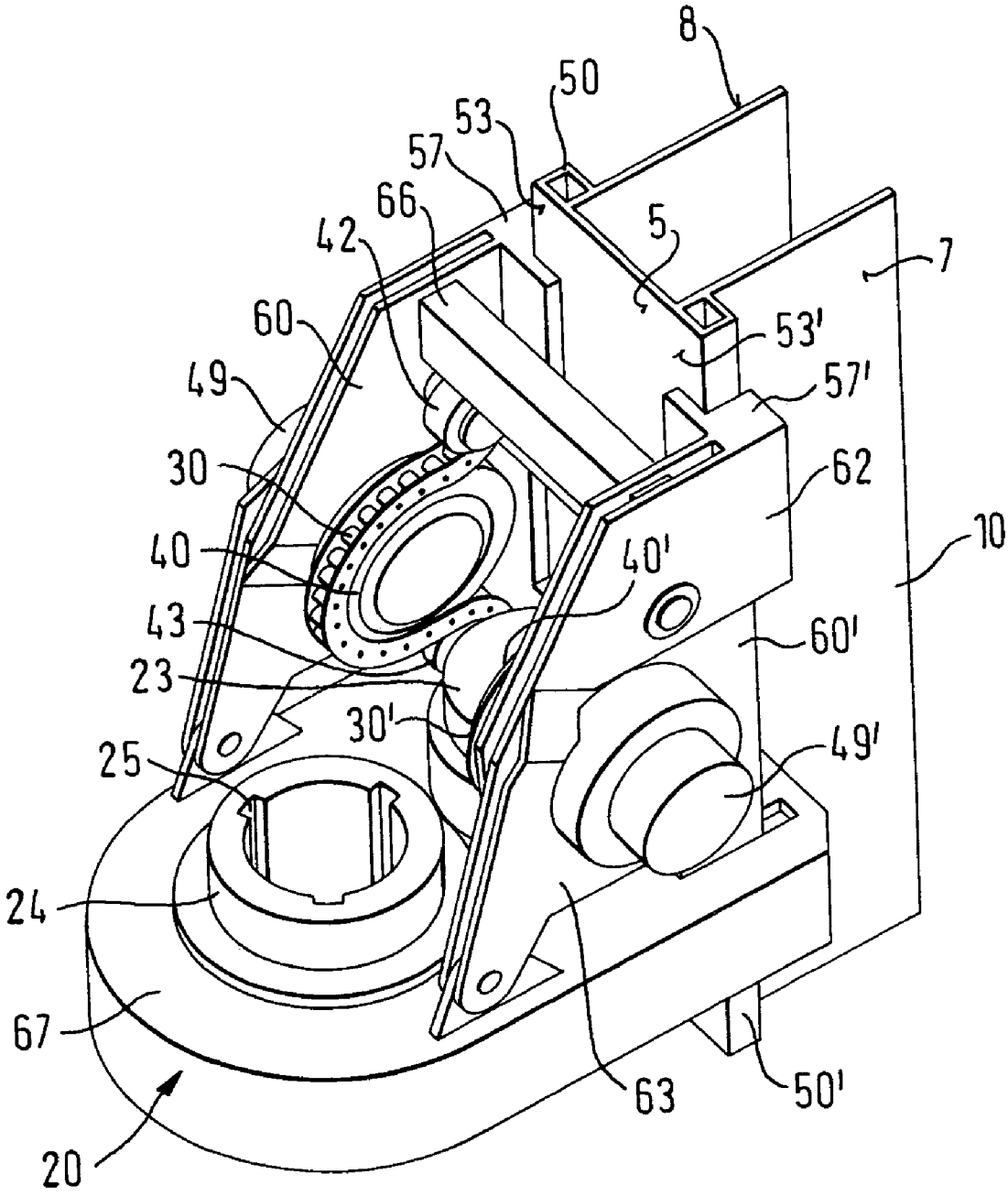

The invention relates to a construction apparatus according to the preamble of claim 1 comprising a mast, a slide guided in a longitudinally displaceable manner on a front side of the mast for supporting a tool, at least one drive chain for the slide arranged longitudinally to the mast, at least one drive pinion supported on the slide in a rotatable manner, which is engaged with the drive chain, and at. least one driving device to drive the drive pinion in a rotational manner for the longitudinal displacement of the slide.

A construction apparatus according to the preamble is known from JP 10-266762 A. This printed publication describes a construction apparatus comprising a carriage, at whose upper carriage a mast is arranged on the front side. A slide is guided in a longitudinally displaceable manner on the front side of the mast. On the slide a support for a drilling tool is arranged in front of the front side of the mast. On the left and on the right side of the mast, i.e. on both longitudinal sides of the mast disposed adjacent to the front side of the mast, a respective drive chain extends longitudinally on the mast. For the active displacement of the slide a drive pinion is provided on the left and on the right side of the mast, each of which is connected to the slide, provided with a drive and engages in the respective drive chain.

The object of the invention is to provide a construction apparatus according to the preamble that is particularly reliable and compact.

The object is solved in accordance with the invention by a construction apparatus having the features of claim 1. Preferred embodiments are stated in the dependent claims.

The construction apparatus according to the invention is characterized in that the drive chain and the drive pinion are arranged in the direction of the slide in front of the front side of the mast.

A fundamental idea of the invention may be seen in the fact that the drive chain and the drive pinion are not provided on the left or right side of the mast but that these components are arranged on the front side of the mast, on which in particular the tool or an accommodating part, i.e. a support for the tool, is provided, too. Owing to the arrangement, in accordance with the invention, of the drive pinion and the drive chain on the front side of the mast, a lateral projection of the slide on the mast can be prevented and a particularly compact slide can be achieved thereby. This is of particular advantage if, for transport purposes of the construction apparatus, the mast can be pivoted on a carriage about a pivot axis extending approximately parallel to the front side of the mast because according to the invention there is no need for the provision of any free spaces on the carriage in order to accommodate drive pinions protruding laterally from the mast.

Due to the fact that according to the invention the drive pinion does not protrude laterally from the slide but is arranged in front of the mast in a portion, in which the accommodating part is provided too, the drive pinion is particularly well-protected against external influences, for example through the accommodating part and/or the tool accommodated therein, so that the reliability of the construction apparatus is increased further. In addition, the arrangement according to the invention of the drive pinion and the drive chain renders it possible for the slide to be pressed with its accommodating part against the front side of the mast through a tensioning of the drive chain, whereby a particularly reliable guidance of the slide is ensured.

In accordance with the invention the front side of the mast can be understood as a longitudinal side of the mast which is suitably designed with an at least approximately rectangular cross section. Advantageously, the front side of the mast is designed in an at least approximately plane manner. According to the invention the arrangement of an element in front of the front side can be understood in particular in that this element lies on a perpendicular line extending outside of the mast with respect to the front side. By preference, the mast has at least one guide rail protruding laterally from the mast, and here the front side of the mast can also comprise the front side of this guide rail. The front side of the mast can be understood more particularly as the mast side, on which the support for the tool is provided on the slide.

The tool concerned here can be a soil working implement for example, more particularly a drill having a drill rod or an injection rod.

The reliability of the construction apparatus according to the invention can be increased further in that two drive chains and two drive pinions are provided, which are prefereably arranged at least approximately paraxially, in particular coaxially on the slide. The paraxial or coaxial arrangement is to be understood more particularly with respect to the axes of rotation of the pinions. As a result of this arrangement, according to the invention, of two drive pinions and two drive chains the front contact pressure of the slide acting on the mast can be increased further and consequently the reliability of the front guidance of the slide can be improved further. In addition, the lateral guidance of the slide can equally be improved. What is more, the coaxial arrangement of the two drive pinions allows for a particularly simple design of the driving device for driving these drive pinions in a rotational manner. More particularly, a common drive shaft may be provided for both drive pinions. In principle, in accordance with the invention it is also possible to provide three or more drive chains and/or three or more drive pinions. Provision can also be made for two or more drive pinions to each engage in the at least one drive chain. If several drive chains and/or drive pinions are provided, they are advantageously arranged in the direction of the slide in front of the front side of the mast. In addition to the at least one drive chain and the at least one drive pinion further chains and/or pinions may be provided e.g. laterally on the mast.

Furthermore, in accordance with the invention it is particularly preferred that the front side of the mast has at least one guiding device for the slide comprising a guide surface. The guiding device can have at least one guide rail for example that extends in particular on the left and/or the right side of the mast longitudinally thereto, and at least one guide member arranged on the slide that rests against the guide rail. Advantageously, a guide rail is each provided on both sides of the mast. The guide surface suitably extends on the front side of the mast. In principle, however, guide surfaces arranged in a different way may also be provided.

Moreover, it is particularly advantageous that the axis of rotation of the at least one drive pinion is directed at least approximately parallel to the guide surface. As a result, a particularly reliable guidance of the slide on the guide surface can be achieved.

For instance provision can be made for the at least one drive chain to be arranged in such a manner that it extends across its entire length along the mast at least approximately in the shape of a straight line. However, it is particularly preferred that the at least one drive chain revolves around the associated drive pinion on a front side of the pinion facing away from the mast whilst generating a pressing force directed towards the front side of the mast. In an arrangement of such kind the slide is pressed through the pressing force towards the front side of the mast, especially towards the guide surface, which permits a particularly reliable guidance even in the case of changing loads present on the accommodating part.

An advantageous development of the construction apparatus according to the invention resides in the fact that a tensioning device, comprising in particular a hydraulic tensioning cylinder, is provided for adjusting a tensional force of the at least one drive chain. If the construction apparatus includes several drive chains, each of these drive chains can be provided with a separate tensioning device. However, provision can also be made for a common tensioning device for several drive chains. Since, according to the invention, the drive chains are arranged on the same side of the mast such a common tensioning device can be designed in a particularly simple way from a constructional point of view. For example a common tensioning yoke may be provided, on which the ends of several drive chains are arranged and which has for example a common tensioning cylinder or any other tensioning drive for the tensioning of these drive chains.

A particularly reliable guidance of the at least one drive chain on the at least one drive pinion can be provided in that above and/or below the at least one drive pinion at least one guide gear-wheel is provided each that is engaged with the at least one drive chain. If several drive pinions and drive chains are provided, it is suitable that above and/or below each of the drive pinions at least one guide gear-wheel is provided respectively, which is engaged with the drive chain associated with the drive pinion. Within the meaning of the invention the indications "above" and "below" are to be understood as being related to the longitudinal direction of the mast. The underside of the mast can be understood in particular as the side on which the tool projects from the mast. Basically, the mast can extend in the vertical direction but it can also be inclined or extend horizontally. If the construction apparatus includes guide gear-wheels, the drive chain suitably revolves around these guide gear-wheels on a gear-wheel rear facing towards the mast.

In the case that several drive pinions are provided, it is possible in accordance with the invention that these drive pinions each have their own driving device. However, it is particularly preferred that the drive pinions have a common driving device. As a result, a particularly economical construction apparatus can be obtained. The arrangement according to the invention of the drive pinions on the same side of the mast permits a particularly simple design of the common driving device. For instance a common drive shaft may be provided for the drive pinions, so that a gear unit of the driving device can be constructed in a particularly simple manner. In addition to a gear unit the driving device suitably includes a drive motor, more particularly a hydraulic rotary motor.

A construction apparatus designed in a particularly simple manner can be achieved in that the drive pinions are of identical design.

If the tool to be accommodated in the support is to be turned during operation, provision is made according to the invention for the slide to have a power rotary head. Such a power rotary head has a drive, especially a hydraulic drive, by means of which the accommodating part and consequently the tool to be accommodated therein can be driven in a rotational manner. A power rotary head of such type may be provided for example if the tool concerned is a drill and/or an injection rod.

A construction device that is of a particularly simple design whilst being at the same time reliable can be achieved in that the slide has two front plates, which extend in particular at least approximately parallel and on which a drive pinion is each arranged, in particular facing towards each other. Owing to the fact that the drive pinions are arranged facing each other, these and, if provided, the revolving drive chains are protected by the front plates in a particularly simple and effective way against external influences, whereby the reliability of the construction apparatus is increased further. Advantageously, the at least one driving device is provided on the front plates, too. In the case of a construction apparatus designed in a particularly simple manner the front plates extend at least approximately parallel to the left and/or the right side of the mast. In principle, the two front plates can also be designed in several parts. For example the front plates can have an upper plate part and a lower plate part, in which case these parts can be connected in a detachable manner to each other and/or damped with respect to each other. This may be of particular advantage if the slide is designed in several parts with a lower slide part being pivotable with respect to an upper slide part for particularly compact transport dimensions.

A particularly robust construction apparatus is provided in that the slide has at least two connecting members, by means of which the two front plates are connected both above and below the two drive pinions. Advantageously, the accommodating part and, if applicable, a rotary drive assigned to the accommodating part is arranged in a lower connecting member of the two connecting members, while an upper connecting member is designed as a yoke. More particularly, the upper connecting member can connect the upper plate parts of the front plates and the lower connecting member can connect the lower plate parts.

In the following the invention will be described in greater detail by way of a preferred embodiment illustrated in the single FIGURE, wherein is schematically shown:

FIG. 1 shows a schematic illustration of a construction apparatus according to the invention with the mast being depicted sectionally and in part only.

A construction apparatus according to the invention is schematically shown in FIG. 1. The construction apparatus includes a mast 10 which may be arranged in particular in a pivotable manner on a construction vehicle not depicted here. The mast 10 has an approximately U-shaped cross section. At the front side 5 of the mast 10, that is designed in the cross section between the two legs of the U-shaped cross section, a slide 20 is supported in a longitudinally displaceable manner on the mast 10.

The slide 20 has a sleeve-shaped accomodating part 24, in which a passage having an approximately circular cross section is designed for accommodating a soil working implement. In addition, in the inside of the sleeve-shaped accomodating part 24 three longitudinally extending grooves 25 are provided for the form-fitting connection of the accomodating part 24 with the drilling tool to be accommodated therein. Furthermore, the slide 20 has a hydraulic rotary drive 23 to drive the accomodating part 24 in a rotational manner together with the tool accommodated therein.

For the guidance of the slide 20 on the mast 10 two guide rails 50, 50' are provided at the front side 5 of the mast that protrude from the mast 10 on the right mast side 8 and on the left mast side 7, respectively. At the front of these guide rails 50, 50' guide surfaces 53, 53' are designed, against which the slide 20 rests by means of L-shaped guide members 57, 57' designed on the said slide.

For the active longitudinal displacement of the slide 20 along the mast 10 two drive chains 30, 30', depicted only in part here, are provided, into which the slide 20 is suspended. The drive chains 30, 30' extend at the front side 5 of the mast 10 in front of the guide surfaces 53, 53' of the guide rails 50, 50' and longitudinally to the said mast 10.

On the slide 20 two driven drive pinions 40, 40' are provided, with only a small portion of drive pinion 40' being recognizable in the illustration of FIG. 1. The two drive pinions are arranged coaxially to each other and each include a driving device 49, 49' designed as hydraulic rotary motor.

The guidance of the drive chains 30, 30' around the respective drive pinions 40, 40' will be described in the following by way of the example of the drive pinion 40 arranged on the right hand-side. The guidance of the chain on drive pinion 40' on the left hand-side is designed in the same way.

At the top of the slide 20 the drive chain 30 runs into an upper guide gear-wheel 42. The drive chain 30 is guided around this upper guide gear-wheel 42 on a gear-wheel rear facing towards the mast 10 and extends from there to the drive pinion 40. Around this drive pinion 40 the drive chain 30 is guided on a pinion front side facing away from the mast 10. From the drive pinion 40 the drive chain 30 again runs to a lower guide gear-wheel 43, around which the drive chain 30 is once more guided on a gear-wheel rear facing towards the mast 10. At the lower guide gear-wheel 43 the drive chain 30 runs out of the slide 20 whilst continuing its way longitudinally to the mast 10. The two guide gear-wheels 42 and 43 are of identical design and are arranged equidistant to the drive pinion 40. Likewise, on the left side of the slide 20 corresponding guide gear-wheels are also arranged around drive pinion 40'.

The slide 20 has a lower connecting member 67 designed as a power rotary head, in which the accomodating part 24 as well as the rotary drive 23 are provided. On this lower connecting member 67 a front plate 60, 60' is arranged each on the right and on the left side, with the two front plates 60, 60' extending approximately parallel to the right mast side 8 and the left mast side 7. It is on these front plates 60, 60' that the two driving devices 49, 49' for the drive pinions 40, 40' are provided. The drive pinions 40, 40' are themselves facing each other and are provided on the inside of the slide on the two front plates 60, 60'. As a result of this arrangement the two drive pinions 40, 40' as well as the revolving drive chains 30, 30' are protected by the front plates 60, 60' against external influences.

At the top the two front plates 60, 60' are connected by an upper connecting member 66 designed as a yoke. Likewise, the guide members 57, 57' are also arranged at the top of the front plates 60, 60'. However, corresponding guide members, not depicted here, can also be provided on the lower connecting member 67.

As is illustrated in particular by way of the example of the front plate 60' arranged on the left side, the two front plates 60, 60' are designed in two parts and each include an upper plate part 62 and a lower plate part 63. The lower plate part 63 is hinged to the lower connecting member 67 by means of bolt connections. If required, the two plate parts 62, 63 can be designed in a detachable manner, in which case provision can be made for the lower connecting member 67 to be pivotably designed with respect to the upper connecting member 66.

The two drive pinions 40, 40' have a common axis of rotation that extends parallel to the front side 5 of the mast 10, in particular to the two guide surfaces 53, 53', and perpendicularly to the longitudinal direction of the mast 10.

The invention claimed is:

1. Construction apparatus employing a tool, the apparatus comprising:

a mast;

a rotary drive for driving the tool;

a slide guided in a longitudinally displaceable manner on a front side of the mast for accommodating the tool, the slide including a lower connecting member for accommodating the rotary drive for driving the tool;

two front plates pivotally mounted to the lower connecting member and extending substantially parallel to lateral sides of the mast, the two front plates each having inner and outer sides;

two drive chains into which the slide is suspended, the two drive chains arranged longitudinally to the mast;

two drive pinions coaxially-arranged and rotatably supported on the inner sides of the two front plates, the two drive pinions being engaged with a respective one of the two drive chains; two driving devices to drive the two drive pinions in a rotational manner for the longitudinal displacement of the slide, the two driving devices being arranged on the outer sides of the two front plates; and the rotary drive arranged on the lower connecting member between the two front plates, wherein the two drive chains and the two drive pinions are arranged in the direction of the slide in front of the front side of the mast; the two drive chains revolve around the associated drive pinion on a front side of the pinion facing away from the mast while generating equal pressing forces directed towards the front side of the mast.

2. Construction apparatus according to claim 1, wherein the front side of the mast has at least one guiding device for the slide comprising a guide surface.

3. Construction apparatus according to claim 2, wherein the axis of rotation of each of the two drive pinions is directed parallel to the guide surface.

4. Construction apparatus according to claim 1, wherein above and/or below at least one of the drive pinions at least one guide gear-wheel is provided wherein each provided guide gear-wheel is engaged with at least one of the drive chains.

5. Construction apparatus according to claim 1, wherein the two drive pinions are of identical design.

6. Construction apparatus according to claim 1, wherein the slide has a power rotary head.

7. Construction apparatus according to claim 1, wherein the drive pinions are arranged facing towards each other.

8. Construction apparatus according to claim 7, wherein the slide has at least two connecting members, by means of which the two front plates are connected both above and below the two drive pinions.

9. Construction apparatus according to claim 1, wherein the two driving devices and the two drive pinions are arranged at least approximately coaxially on the slide.

10. Construction apparatus according to claim 1, wherein above and/or below the at least one drive pinion at least one guide gear-wheel is provided, wherein each provided guide gear-wheel is engaged with the at least one drive chain.

11. Construction apparatus according to claim 1, wherein the slide has at least two connecting member, by means of which the two front plates are connected both above and below the two drive pinions.

12. Construction apparatus according to claim 1, wherein the slide has a power rotary head.

13. Construction apparatus according to claim 1, where the two drive pinions are of identical design.

14. Construction apparatus according to claim 1, wherein the front side of the mast has at least one guiding device for the slide comprising a guide surface.

15. Construction apparatus according to claim 1, wherein the two front plates are designed in two parts, each front plate including an upper plate and a lower plate.

16. Construction apparatus according to claim 15, wherein the lower plate part is hinged to the lower connecting member.

17. Construction apparatus according to claim 15, further comprising damping members provided between the upper plate part and the lower plate part.

* * * * *